US006604912B2

(12) United States Patent
Suitou et al.

(10) Patent No.: US 6,604,912 B2
(45) Date of Patent: Aug. 12, 2003

(54) CONTROL VALVE USED FOR A VARIABLE DISPLACEMENT COMPRESSOR INSTALLED IN A REFRIGERANT CIRCUIT HAVING AT LEAST ONE OF A FIRST PRESSURE CHAMBER AND A SECOND PRESSURE CHAMBER FORMING PART OF THE REFRIGERANT CIRCUIT

(75) Inventors: Ken Suitou, Kariya (JP); Masaki Ota, Kariya (JP); Kazuya Kimura, Kariya (JP); Taku Adaniya, Kariya (JP); Ryo Matsubara, Kariya (JP); Satoshi Umemura, Kariya (JP); Izuru Shimizu, Kariya (JP); Naoya Yokomachi, Kariya (JP); Toshiro Fujii, Kariya (JP); Yuji Hashimoto, Kariya (JP); Masakazu Murase, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/924,238

(22) Filed: Aug. 7, 2001

(65) Prior Publication Data

US 2002/0037223 A1 Mar. 28, 2002

(30) Foreign Application Priority Data

Aug. 7, 2000 (JP) ..... 2000-238830
Jan. 16, 2001 (JP) ..... 2001-007816
May 23, 2001 (JP) ..... 2001/154357

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3

(56) References Cited

U.S. PATENT DOCUMENTS 6,336,335 B2 * 1/2002 Ota et al. ..... 123/198 R
6,371,734 B1 * 4/2002 Ota et al. ..... 417/222.2
6,382,926 B2 * 5/2002 Ota et al. ..... 417/222.2
6,385,979 B2 * 5/2002 Ota et al. ..... 62/115
6,386,834 B1 * 5/2002 Kimura et al. ..... 417/222.2
2001/0002237 A1 * 5/2001 Ota et al. ..... 417/222.2
2001/0008131 A1 * 7/2001 Ota et al. ..... 123/339.17
2001/0013225 A1 * 8/2001 Ota et al. ..... 62/228.5
2001/0014287 A1 * 8/2001 Ota et al. ..... 417/213
2001/0027658 A1 * 10/2001 Ota et al. ..... 62/228.3
2001/0027659 A1 * 10/2001 Ota et al. ..... 62/228.3
2001/0052236 A1 * 12/2001 Ota et al. ..... 62/228.3
2001/0055531 A1 * 12/2001 Ota et al. ..... 417/222.2
2002/0004011 A1 * 1/2002 Suitou et al. ..... 417/222.2
2002/0011074 A1 * 1/2002 Suitou et al. ..... 62/228.3
2002/0031432 A1 * 3/2002 Ota et al. ..... 417/222.2
2002/0035842 A1 * 3/2002 Suitou et al. ..... 62/228.3
2002/0037223 A1 * 3/2002 Suitou et al. ..... 417/222.2
2002/0064467 A1 * 5/2002 Ota et al.

FOREIGN PATENT DOCUMENTS

JP 11-324930 11/1999 ..... F04B/49/00

OTHER PUBLICATIONS

U.S. Patent Application Ser. No. 09/851, 706 filed May 9, 2001.
U.S. Patent Application Ser. No. (to be assigned) filed on Jun. 6, 2001.

* cited by examiner

*Primary Examiner*—Charles G. Freay
*Assistant Examiner*—William H. Rodriguez
(74) *Attorney, Agent, or Firm*—Morgan & Finnegan, LLP

(57) ABSTRACT

A control valve is used for a variable displacement compressor installed in a refrigerant circuit of a vehicle air conditioner. The control valve has a valve housing. A valve chamber is defined in the valve housing. A valve body is accommodated in the valve chamber. A pressure sensing chamber is defined in the valve housing. A pressure sensing member separates the pressure sensing chamber into a first pressure chamber and a second pressure chamber. The pressure at a first location in the refrigerant circuit is applied to the first pressure chamber. The pressure at a second location in the refrigerant circuit, which is downstream of the first location, is applied to the second pressure chamber. The pressure sensing member moves the valve body in accordance with the pressure difference between the first pressure chamber and the second pressure chamber such that the displacement of the compressor is varied to counter changes of the pressure difference. At least one of the first pressure chamber and the second pressure chamber forms a part of the refrigerant circuit.

19 Claims, 4 Drawing Sheets

CONTROL VALVE USED FOR A VARIABLE DISPLACEMENT COMPRESSOR INSTALLED IN A REFRIGERANT CIRCUIT HAVING AT LEAST ONE OF A FIRST PRESSURE CHAMBER AND A SECOND PRESSURE CHAMBER FORMING PART OF THE REFRIGERANT CIRCUIT

BACKGROUND OF THE INVENTION

The present invention relates to a control valve for controlling the displacement of a variable displacement compressor, which is used, for example, in a vehicle air conditioner.

A typical vehicle air conditioner includes a condenser, an expansion valve, as a depressurizing device, an evaporator, and a compressor. The compressor draws refrigerant gas from the evaporator, compresses it, and then discharges the compressed gas to the condenser. The evaporator transfers heat between the refrigerant flowing in the refrigerant circuit and air in the vehicle. In accordance with the cooling load, the heat of air passing near the evaporator is transferred to the refrigerant flowing in the evaporator. The pressure of the refrigerant gas in the vicinity of the outlet of the evaporator reflects the cooling load.

A swash plate type variable displacement compressor for such an air conditioner is provided with a displacement control system for steering the pressure near the outlet of the evaporator (suction pressure Ps) to a target suction pressure. The displacement control system controls the discharge displacement of the compressor by referring to the suction pressure Ps to obtain a flow rate that corresponds to the cooling load.

However, in a compressor that refers the suction pressure Ps to control the refrigerant flow rate, when the flow rate of refrigerant in the refrigerant circuit changes in accordance with a change of the engine speed, the displacement of the compressor does not always change immediately in response to the change of the flow rate. For example, if the engine speed increases and the flow rate of refrigerant increases accordingly when the thermal load on the evaporator is great, the compressor displacement does not start decreasing until the actual auction pressure falls below the target suction pressure. As the engine speed increases, the power required for operating the compressor increases, which lowers the fuel economy.

BRIEF SUMMARY OF THE INVENTION

Accordingly, it is an objective of the present invention to provide a control valve that quickly changes the displacement of a variable displacement compressor regardless of the thermal load on an evaporator.

To attain the above object, the present invention provides a control valve used for a variable displacement compressor installed in a refrigerant circuit of a vehicle air conditioner. The compressor varies the displacement in accordance with the pressure in a crank chamber. The compressor has a control passage, which connects the crank chamber to a pressure zone in which the pressure is different from the pressure of the crank chamber. The control valve comprise a valve housing. A valve chamber is defined in the valve housing. A valve body, which is accommodated in the valve chamber adjusts the opening size of the control housing. A pressure sensing member, which separates the pressure sensing chamber into a first pressure chamber and a second pressure chamber. The pressure at a first location in the refrigerant circuit is applied to the first pressure chamber. The pressure at a second location in the refrigerant circuit, which is downstream of the first location, is applied to the second pressure chamber. The pressure sensing member moves the valve body in accordance with the pressure difference between the first pressure chamber and the second pressure chamber such that the displacement of the compressor is varied to counter changes of the pressure difference. At least one of the first pressure chamber and the second pressure chamber forms a part of the refrigerant circuit.

Other aspects and advantages of the invention will become apparent from the following description, taken in conjunction with the accompanying drawings, illustrating by way of example the principal of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which:

FIG. 5(*b*) is a diagrammatic view showing forces acting on the pressure-sensing member of the control valve shown in FIG. 5(*a*);

DETAILED DESCRIPTION OF THE PREFERRED EMBODIMENTS

A control valve used in a swash plate type variable displacement compressor incorporated in the refrigerant circuit of a vehicle air conditioner will be described with reference to FIGS. 1 and 2.

Figure 1:
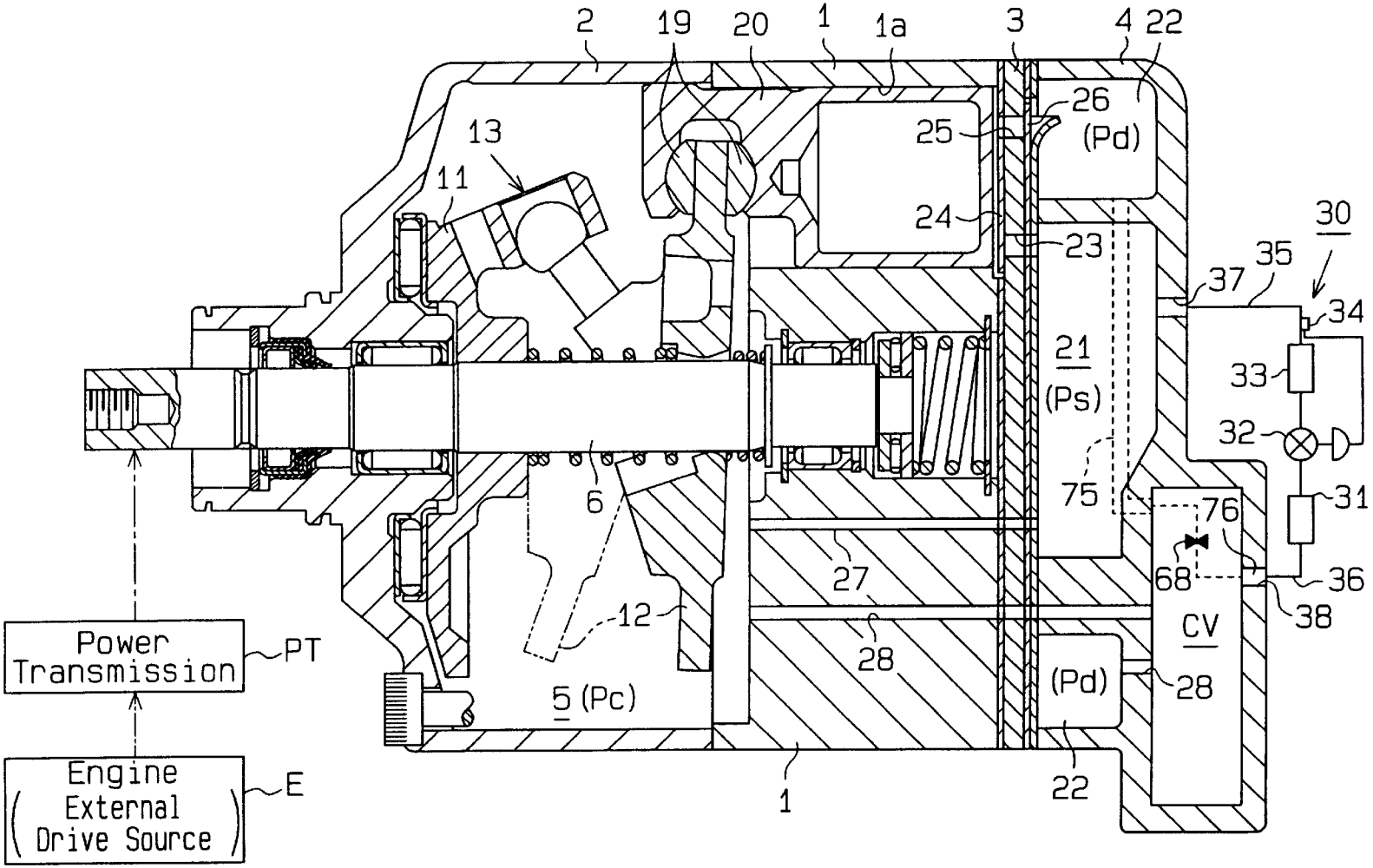
FIG. 1 is a cross-sectional view illustrating a variable displacement compressor according to a first embodiment.

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing mender 4 and the cylinder block 1. The front housing member 2, the cylinder block 1 and the rear housing member 4 form a housing assembly of the compressor. The left side and the right side in FIG. 1 correspond to the front end and the rear end, respectively.

A crank chamber 5 is defined between the cylinder block 1 and the front housing member 2. A drive shaft 6 is supported in the crank chamber 5 by bearings. A lug plate 11 is fixed to the drive shaft 6 in the crank chamber 5 to rotate integrally with the drive shaft 6.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Formed in the cylinder block 1 are cylinder bores 1*a* (only one is shown in FIG. 1) at constant angular intervals around the drive shaft 6. Each cylinder bore 1*a* accommodates a single headed piston 20 such that the piston can reciprocate in the bore 1*a*. In each bore 1*a* is a compression chamber, the volume of which varies in accordance with the reciprocation of the piston 20. The front end of each piston 20 is connected to the periphery of the swash plate 12 through a pair of shoes 19. As a result, the rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore 1*a*, a suction port 23, a suction valve 24 for opening and closing the suction port 23, a discharge port 25, and a discharge valve 26 for opening and closing the discharge port 25. The suction chamber 21 communicates with each cylinder bore 1*a* through the corresponding suction port 23, and each cylinder bore 1*a* communicates with the discharge chamber 22 through the corresponding discharge port 25.

When the piston 20 in a cylinder bore 1*a* moves from its top dead center position to its bottom dead center position, the refrigerant gas in the suction chamber 21 flows into the cylinder bore 1*a* through the corresponding suction port 23 and the corresponding suction valve 24. When the piston 20 moves from its bottom dead center position toward its top dead center position, the refrigerant gas in the cylinder bore 1*a* is compressed to a predetermined pressure, and it forces the corresponding discharge valve 26 to open. The refrigerant gas is then discharged through the corresponding discharge port 25 and the corresponding discharge valve 26 into the discharge chanter 22.

The inclination angle of the swash plate 12 (the angle between the swash plate 12 and a plane perpendicular to the axis of the drive shaft 6) is determined on the basis of various moments such as the moment of rotation caused by the centrifugal force upon rotation of the swash plate, the moment of inertia based on the reciprocation of the piston 20, and a moment due to the gas pressure. The moment due to the gas pressure is based on the relationship between the pressure in the cylinder bores 1*a* and the crank pressure Pc. The moment due to the gas pressure increases or decreases the inclination angle of the swash plate 12 in accordance with the crank pressure Pc.

In this embodiment, the moment due to the gas pressure is changed by controlling the crank pressure Pc with a crank pressure control mechanism. The inclination angle of the swash plate 12 can be changed to an arbitrary angle between the minimum inclination angle (shown by a solid line in FIG. 1) and the maximum inclination angle (shown by a broken line in FIG. 1).

The crank pressure control mechanism includes a bleed passage 27, a supply passage 28, and a control valve CV, all of which are provided in the housing of the compressor shown in FIG. 1. The bleed passage 27 connects the crank chamber 5 with the suction chamber 21, which is a suction pressure Ps region. The supply passage 28 connects the crank chamber 5 with the discharge chamber 22, which is a discharge pressure Pd region. The control valve CV is located in the supply passage 28.

By controlling the degree of opening of the control valve CV, the relationship between the flow rate of high-pressure gas flowing into the crank chamber 5 through the supply passage 28 and the flow rate of gas flowing out of the crank chamber 5 through the bleed passage 27 is controlled to determined the crank pressure Pc. In accordance with a change in the crank pressure Pc, the difference between the crank pressure Pc and the pressure in each cylinder bore 1*a* is changed to change the inclination angle of the swash plate 12. As a result, the stroke of each piston 20, i.e., the discharge displacement, is adjusted.

As shown in FIG. 1, the refrigerant circuit of the vehicular air-conditioning system is made up of the compressor and an external refrigerant circuit 30. The external refrigerant circuit 30 includes, a condenser 31, an expansion valve 32 as a depressurizing system, and an evaporator 33. The degree of opening the expansion valve 32 is feed-back controlled on the basis of the temperature detected by a temperature-sensing tube 34, which is provided near the outlet of the evaporator 33, and the evaporation pressure (the pressure near the outlet of the evaporator 33). The expansion valve 32 sends to the evaporator 33 liquid refrigerant, the flow rate of which corresponds to the thermal load, and controls the flow rate of the refrigerant in the external refrigerant circuit 30.

In the external refrigerant circuit 30, a first conducting pipe 35 is provided downstream of the evaporator 33 to connect the outlet of the evaporator 33 with an inlet port 37, which is formed in the rear housing member 4. In the external refrigerant circuit 30, a second conducting pipe 36 is provided upstream of the condenser 31 to connect the inlet of the condenser 31 with an outlet port 38, which is located in the rear housing member 4. The compressor draws refrigerant gas into the suction chamber 21 through the inlet port 37 from the downstream end of the external refrigerant circuit 30 and compresses it. The compressor then discharges the compressed gas to the discharge chamber 22, which is connected through the outlet port 38 to the upstream end of the external refrigerant circuit 30.

Figure 2:
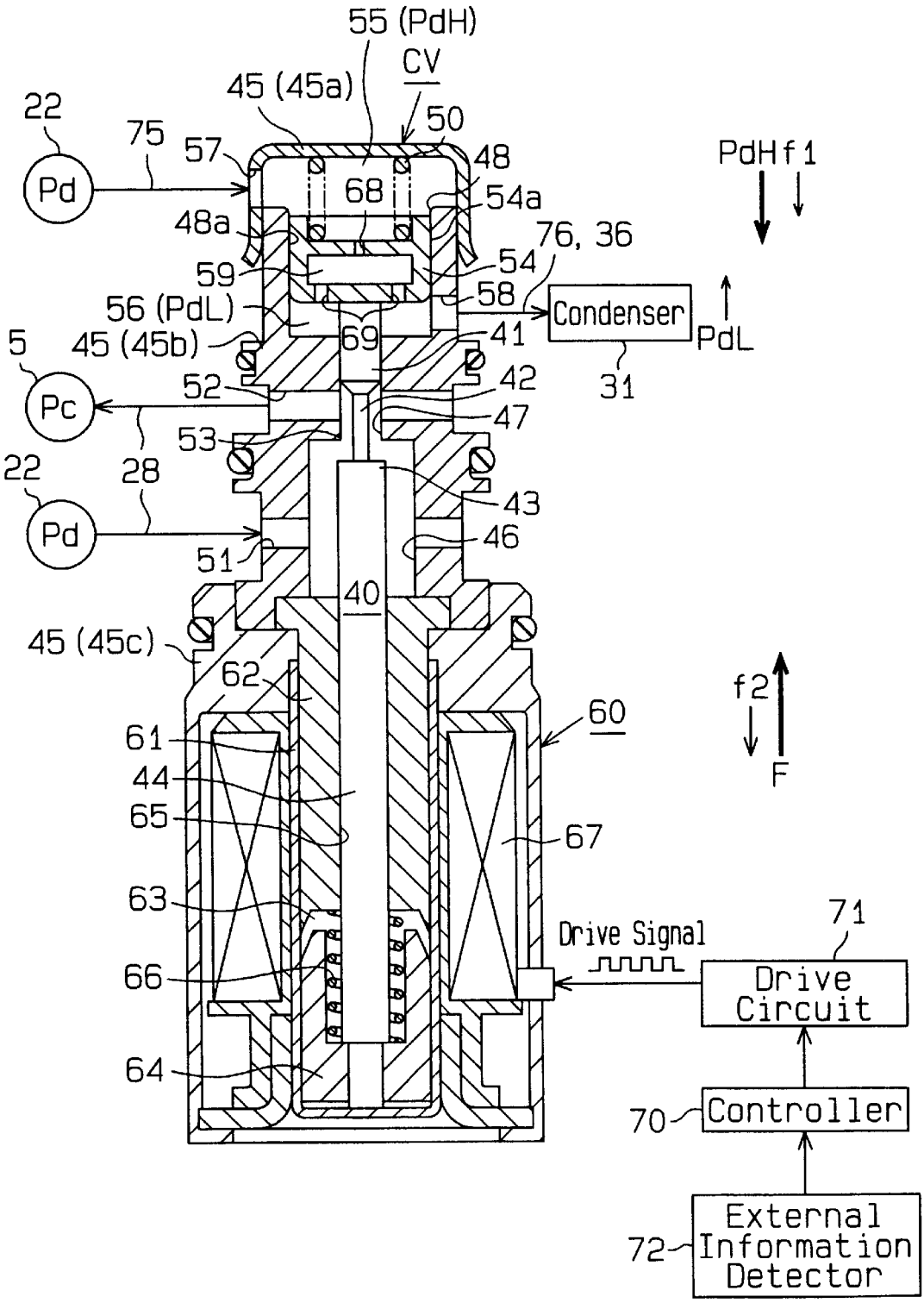
FIG. 2 is a cross-sectional view illustrating the control valve in the compressor shown in FIG. 1.

Referring to FIG. 2, the control valve CV includes a supply side valve portion and a solenoid portion 60. The supply side valve portion controls the degree of opening the supply passage 20 connecting the discharge chamber 22 with the crank chamber 5. The solenoid portion 60 serves as an electromagnetic actuator for controlling an operation rod 40 provided in the control valve CV on the basis of the level of an externally supplied current. The operation rod 40 has a distal end portion 41, a valve body portion 43, a connecting portion 42, which joins the distal end portion 41 with the valve body portion 43, and a guide portion 44. The valve body portion 43 is part of the guide portion 44.

A valve housing 45 of the control valve CV includes a cap 45*a*, an upper-half body 45*b*, and a lower-half body 45*c*. A valve chamber 46 and a communication passage 47 are defined in the upper-half body 45*b*. A pressure-sensing chamber 48 is defined between the upper half body 45*b* and the cap 45*a*.

In the valve chamber 46 and the communication passage 47, the operation rod 40 moves axially. The valve chamber 46 communicates with the communication passage 47 selectively in accordance with the position of the operation rod 40. The communication passage 47 is isolated from the pressure-sensing chamber 48 by the distal end portion 41.

The upper end face of a fixed iron core 62 serves as the bottom wall or the valve chamber 46. A port 51 extending radially from the valve chamber 46 connects the valve chamber 46 with tho discharge chamber 22 through an upstream part of the supply passage 28. A port 52 extending radially from the communication passage 47 connects the communication passage 47 with the crank chamber 5 through a downstream part of the supply passage 28. Thus, the port 51, the valve chamber 46, the communication passage 47, and the port 52 serve as part of the supply passage 28, which connects the discharge chamber 22 with the crank chamber 5 and serves as the control passage.

The valve body portion 43 of the operation rod 40 is located in the valve chamber 46. The inner diameter of the communication passage 47 is larger than the diameter of the connecting portion 42 of the operation rod 40 and smaller than the diameter of the guide portion 44. That is, the cross-sectional area of the communication passage 47 is larger than the cross-sectional area of the connecting portion 42 and smaller than the cross-sectional area of the guide portion 44. A valve seat 53 is formed around the opening of the communication passage 47.

When the operation rod 40 has moved from the position shown in FIG. 2 (the lowest position) to the uppermost position, at which the valve body portion 43 is in contact with the valve seat 53, the communication passage 47 is closed. The valve body portion 43 of the operation rod 40 serves as a supply side valve body that can arbitrarily control the degree of opening of the supply passage 29.

A bottomed cylindrical first pressure-sensing member 54 is provided in the pressure-sensing chamber 48 and is movable axially. The first pressure-sensing member 54 divides the pressure-sensing chamber 48 into two, i.e., first and second, pressure chambers 55 and 56. A communication chamber 59 is defined in the pressure sensing member 54. The communication chamber 59 is connected to the first pressure chamber 55 through a throttle passage 68, which is formed in the pressure-sensing member 54. The communication chamber 59 is also connected to the second pressure chamber 56 through through holes 69 formed in the pressure-sensing member 54. Neither through hole 69 overlaps the distal end portion 41 of the operation rod 40. The communication chamber 59 is exposed to the same pressure as that of the second pressure chamber 56. The throttle passage 68, the communication chamber 59 and the through holes 69 form a control passage, which connects the first pressure chamber 55 to the second pressure chamber 56.

The first pressure chamber 55 accommodates a first spring 50, which is a coil spring. The first spring 50 urges the first pressure-sensing member 54 toward the second pressure chamber 56.

The first pressure chamber 55 is connected to the discharge chamber 22 through a first port 57, which is formed in the cap 45*a*, and a first discharge passage 75, which is formed in the rear housing member 4. The second pressure chamber 56 is connected to the condenser 31 through a second port 58, which is formed in the cap 45*a* of the valve housing 45, a second discharge passage 76, which is formed in the rear housing member 4, the outlet port 38 and the second conducting pipe 36. The first discharge passage 75, the first port 57, the first pressure chamber 55, the throttle passage 68, the communication chamber 59, the through holes 69, the second pressure chamber 56, the second port 58 and the second discharge passage 76, which connect the discharge chamber 22 to the outlet port 38, form a part of the refrigerant circuit. The throttle passage 68, the communication chamber 59 and the through holes 69, which connect the first pressure chamber 55 to the second pressure chamber 56, form a pressure passage.

The greater the flow rate of the refrigerant flowing in the refrigerant circuit is, the greater the pressure loss per unit length of the circuit or piping is. That is, the pressure loss (pressure difference) in the region between two pressure chambers 55 and 56 provided in the refrigerant circuit has a positive correlation with the flow rate of the refrigerant in the circuit. Detecting the difference PdH−PdL between the pressure PdH in the first pressure chamber 55 and the pressure PdL of the second pressure chamber 56, which is 56 is downstream of the first pressure chamber 55, permits the flow rate of refrigerant in the refrigerant circuit to be indirectly detected. Hereinafter, the pressure difference PdH-PdL will be referred to as a pressure difference ΔPd.

The solenoid portion 60 includes a bottomed cylindrical accommodation tube 61. A fixed iron core 62 is fitted in the accommodation tube 61. The solenoid chamber 63 accommodates a movable iron core 64, which is movable axially. An axial guide hole 65 is formed at the center of the fixed iron core 62. In the guide hole 65, the guide portion 44 of the operation rod 40 is movable axially.

A proximal end of the operation rod 40 is accommodated in the solenoid chamber 63. A lower end of the guide portion 44 is fitted in a through hole formed at the center of the movable iron core 64, and the lower end is fixed to the movable iron core 64 by crimping. Thus, the movable iron core 64 is moved vertically together with the operation rod 40.

In the solenoid chamber 63, a second spring 66 of a coil spring is located between the fixed and movable iron cores 62 and 64. The second spring 66 urges tho movable iron core 64 downward, i.e., the direction in which the movable iron core 64 separated from the fixed iron core 62.

A coil 67 is wound around the fixed and movable iron cores 62 and 64. The coil 67 is supplied with a drive signal from a drive circuit 71 based on instructions from a controller 70. The coil 67 generates an electromagnetic force F, the magnitude of which depends on the electric power supplied, between the fixed and movable iron cores 62 and 64. The electric current supplied to the coil 67 is controlled by controlling the voltage applied to the coil 67. In this embodiment, for the control of the applied voltage, a duty control is employed.

As shown in FIG. 2, the vehicular air-conditioning system includes the above-mentioned controller 70. The controller 70 includes a CPU, a ROM, a RAM, and an I/O interface. An external information detector 72 is connected to an input terminal of the I/O interface, and the above-mentioned drive circuit 71 is connected to an output terminal of the I/O interface.

The external information detector 72 includes, for example, an A/C switch can ON/OFF switch of the air-conditioning system to be operated by an occupant in the vehicle), a temperature sensor for detecting the temperature in the passenger compartment, and a temperature setting device for setting the temperature in the passenger compartment.

The controller 70 calculates an adequate duty ratio Dt on the basis of various external information provided from the external information detector 72 and instructs the drive circuit 71 to output a drive signal having the duty ratio Dt. The instructed drive circuit 71 then outputs the drive signal to the coil 67 of the control valve CV. The electromagnetic force F of the solenoid portion 60 of the control valve CV changes in accordance with the duty ratio Dt of the drive signal supplied to the coil 67.

In the control valve CV, the position of the operation rod 40 is determined as follows. Here, the effect of the pressure in the valve chamber 46, the pressure of communication passage 47, and the pressure in the solenoid chamber 63 on positioning of the operation rod 40 is ignored.

As shown in FIG. 2, when the coil 67 is supplied with no electric current (duty ratio=0%), the downward force f1+f2 by the first and second springs 50 and 66 dominantly acts on the operation rod 40. Thus, the operation rod 40 is placed at its lowermost position, and the communication passage 47 is fully opened. The crank pressure Pc is the maximum that is possible under the given conditions. The pressure difference between the crank pressure Pc and the pressure in each cylinder bore 1*a* thus becomes large. As a result, the inclination angle of the swash plate 12 is minimized, and the discharge displacement of the compressor is also minimized.

When the coil 67 is supplied with an electric current having the minimum duty ration or more within the variation range or the duty ratio Dt, the upward electromagnetic force F becomes greater than the downward force f1+f2 of the first and second springs 50 and 66, so that the operation rod 40 is moved upward. In this state, the upward electromagnetic force F, which is countered by the downward force f2 of the second spring 66, opposes the downward force that is based on the pressure difference ΔPd, which adds to the downward force f1 of the first spring 50. That is, the position of the valve body 43 of the operation rod 40 relative to the valve seat 53 is determined such that the upward force F, which is countered by the downward force f2 of the second spring 66, balances with the resultant of the downward force that is based on the pressure difference ΔPd and the downward force of the first spring 50.

For example, if the speed of the engine E decreases, which decreases the flow rate of the refrigerant in the refrigerant circuit, then the pressure difference ΔPd decreases, and the electromagnetic force F at that time cannot maintain the balance of the force acting on the operation rod 40. As a result, the operation rod 40 moves upward, which increases the downward force f1+f2 of the first and second spring 50 and 66. The valve body portion 43 of the operation rod 40 is then positioned so that the increase in the force f1+f2 compensates for the decrease in the pressure difference ΔPd.

As a result, the degree of opening of the communication passage 47 is decreased and the crank pressure Pc is decreased. Therefore, the pressure difference between the crank pressure Pc and the pressure in each cylinder bore 1*a* decreases. Thus, the inclination angle of the swash plate 12 is increased, which increases the discharge displacement of the compressor. When the discharge displacement of the compressor is increased, the flow rate of the refrigerant in the refrigerant circuit is also increased, which increases the pressure difference ΔPd.

Conversely, if the speed of the engine E increases and the flow rate of the refrigerant in the refrigerant circuit increases accordingly, then the pressure difference ΔPd increases and the electromagnetic force F at that time cannot maintain the balance between the forces acting on the operation rod 40. As a result, the operation rod 40 moves downward and the valve body portion 43 of the operation rod 40 is positioned so that the decrease in the downward force f1+f2 by the first and second springs 50 and 66 compensates for the increase in the pressure difference ΔPd.

Therefore, the degree of opening of the communication passage 47 is increased, and the pressure difference between the crank pressure Pc and the pressure in each cylinder bore 1*a* increases. Thus, the inclination angle of the swash plate 12 is decreased and the discharge displacement of the compressor is decreased accordingly. When the discharge displacement of the compressor is decreased, the flow rate of the refrigerant in the refrigerant circuit is also decreased, which decreases the pressure difference ΔPd.

For example, if the duty ratio Dt of the electric current supplied to the coil 67 is increased to increase the electromagnetic force F, the pressure difference ΔPd at that time cannot maintain the balance between the upward and downward forces. As a result, the operation rod 40 moves upward and the valve body portion 43 of the operation rod 40 is positioned so that the increase in the downward force f1+f2 by the first and second springs 50 and 66 compensates for the increase in the upward electromagnetic force F. Therefore, the degree of opening of the communication passage 47 is decreased, which increases the discharge displacement of the compressor. Thus, the flow rate of the refrigerant in the refrigerant circuit is increased, which increases the pressure difference ΔPd.

On the other hand, if the duty ratio Dt of the electric currant supplied to the coil 67 is decreased to decrease the electromagnetic force F, the pressure difference ΔPd at that time cannot maintain the balance between the upward and downward forces. As a result, the operation rod 40 moves downward and the valve body portion 43 of the operation rod 40 is positioned so that the decrease in the downward force f1+f2 by the first and second springs 50 and 66 compensates for the decrease in the upward electromagnetic force F. Therefore, the degree of opening of the communication passage 47 in increased, which decreases the discharge displacement of the compressor. Thus, the flow rate of the refrigerant in the refrigerant circuit is decreased, which decreases the pressure difference ΔPd.

As described above, the control valve CV determines the position of the operation rod 40 according to the fluctuation of the actual pressure difference ΔPd such that the target value of the pressure difference ΔPd, which is set by the duty ratio of the controller 70 in maintained. The controller 70 changes the target pressure difference by changing the duty ratio.

The first embodiment has the following advantages.

The displacement of the compressor is feedback controlled based on the pressure difference ΔPd between the pressure chambers 55, 56, which are defined in the control valve CV in the refrigerant circuit. Thus, the compressor displacement is quickly and reliably controlled based on the fluctuation of the engine speed and by the controller 70 without being influenced by the thermal load on the evaporator 33. Particularly, when the engine speed increases, the compressor displacement is quickly decreased, which improves the fuel economy.

The target discharge pressure can be changed by changing the duty ratio Dt for controlling the current to the coil 67 of the control valve CV. Thus, the control valve CV can perform more delicate control compared with a control valve having no electromagnetic device (solenoid 60 or controller 70) and having only a single target discharge pressure.

The method for controlling the opening of the control valve CV by referring to the flow rate of refrigerant in the refrigerant circuit, or the pressure loss between the upstream portion and the downstream portion (the pressure difference), is not limited to that of FIGS. 1 and 2. For example, the opening of the control valve CV may be controlled by a device shown in FIG. 8, which is shown for purposes of comparison.

Figure 8:
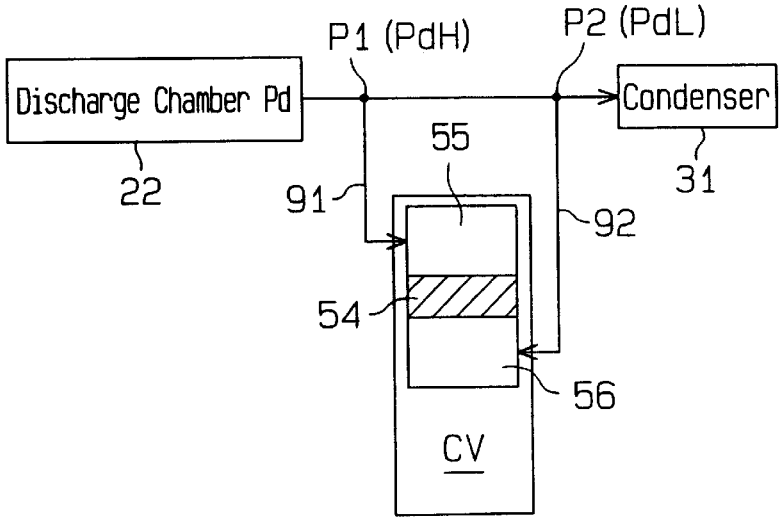
FIG. 8 is a diagrammatic view showing a comparison example of the embodiment shown in FIG. 1.

In the device shown in FIG. 8, two pressure monitoring points P1, P2 are located along the refrigerant circuit. The second pressure monitoring point P2 is located downstream or the first pressure monitoring pint P1. Unlike the embodiment of FIGS. 1 and 2, the pressure-sensing member 54 of FIG. 8 does not have the throttle 68, the communication chamber 59 and the through holes 69. Therefore, the first pressure chamber 55 is isolated from the second pressure chamber 56 by the pressure-sensing member 54. The first pressure chamber 55 is exposed to the pressure PdH at the first pressure monitoring point P1 through a first pressure introduction passage 91. The second pressure chamber 56 is exposed to the pressure PdL at the second pressure monitoring point P2 through a second pressure introduction passage 92.

However, in the embodiment of FIG. 8, the pressure chamber 55, 56 need to be connected to the corresponding pressure sensing points P1, P2 by the corresponding pressure introduction passages 91, 92, respectively. Therefore, the size of the rear housing member 4, in which the suction chamber 21 and the discharge chamber 22 are defined, needs to be increased to provide space for the pressure introduction passages 91, 92, which increases the size of the compressor, However, in the embodiment of FIGS. 1 to 2, each of the pressure chambers 55, 56 forms a part of the refrigerant circuit. Thus, unlike the example of FIG. 8, the embodiment of FIGS. 1 to 2 does not require tho pressure introduction passages 91, 92 for connecting the pressure monitoring points P1, P2 to the pressure chambers 55, 56. Accordingly, the size of the rear housing member 4 is reduced, which reduces the size of the compressor.

When the compressor in operating, refrigerant gas constantly flows into the pressure sensing chamber 48, which is located in the refrigerant circuit. Therefore, foreign matter is not likely to get caught between the surface 54*a* of the pressure-sensing member 54 and the surface 48*a* of the pressure-sensing chamber 48. If foreign matter gets caught between the pressure-sensing member 54 and the pressure-sensing chamber 48, the foreign matter is removed by flowing refrigerant gas. Thus, the life of the pressure-sensing member 54 is extended. That is, the durability of the control valve CV is improved.

The throttle passage 68, the communication chamber 59 and the through holes 69, which connect the pressure chambers 55, 59, are formed in the pressure-sensing member 54. Therefore, the pressure sensing chambers 55, 56 need not be connected to each other through a passage that is formed outside of the control valve CV. In words, there is no need to machine the rear housing member 4 to form an extra passage or to change the position of the control valve CV.

The throttle passage 68 limits the flow of refrigerant gas from the first pressure chamber 55 to the second pressure chamber 56. Thus, the pressure difference ΔPd is sufficient even it the pressure chambers 55, 56 are relatively close. In other words, the pressure-sensing member 54 need not be axially extended for extending the throttle passage 68, the communication chamber 59 and the through holes 69. Accordingly, the size of the pressure-sensing chamber 48, which accommodates the pressure-sensing member 54, is reduced.

In the comparison example of FIG. 8, a throttle may be formed in the refrigerant circuit between the pressure monitoring points P1, P2 to increase tho pressure difference ΔPd. However, to form a throttle in a pipe or a passage in the refrigerant circuit, a tool must be inserted into the pipe or the passage, which are relatively narrow. This complicates the manufacturing and lowers the accuracy. However, in the embodiment of FIGS. 1 to 2, the throttle passage 68 is formed in the pressure-sensing member 54 of the control valve CV. If the throttle passage 68 is formed before the pressure-sensing member 54 is installed in the valve housing 45, there is no interference with other members of the compressor by a tool. Therefore, the throttle passage 68 is easily and accurately formed.

It should be apparent to those skilled in the art that the present invention may be embodied in many other specific forms without departing from the spirit or scope of the invention. Particularly, it should be understood that the invention may be embodied in the following forms.

Figure 3:
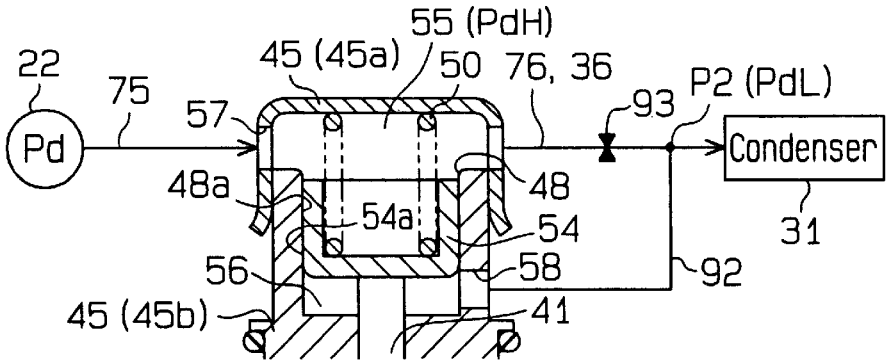
FIG. 3 is an enlarged cross-sectional view illustrating a control valve according to a second embodiment.

As In a second embodiment, which is illustrated in FIG. 3, the throttle passage 68, the communication chamber 59 and the through holes 69 of the embodiment of FIGS. 1 to 2 are omitted. In the embodiment of FIG. 3, the first discharge passage 75 and the second discharge passage 76 are connected to the first pressure chamber 55, and only the first pressure chamber 55 forms a part of the refrigerant circuit.

Figure 4:
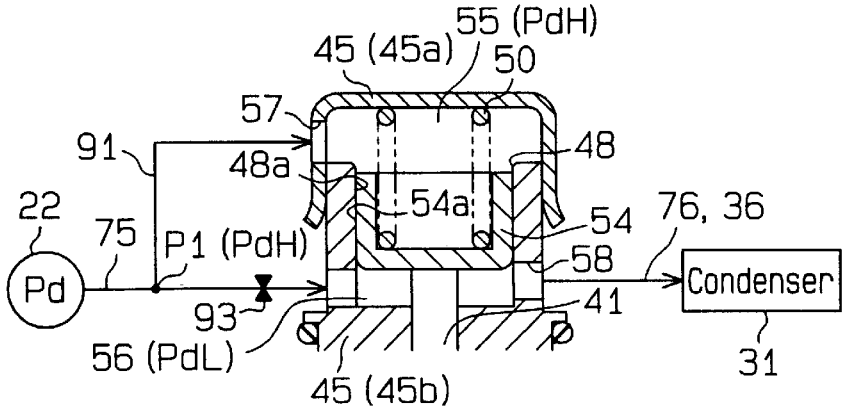
FIG. 4 is an enlarged cross-sectional view illustrating a control valve according to a third embodiment.

As in a third embodiment, which is illustrated in FIG. 4, the throttle passage 68, the communication chamber 59 and the through holes 69 of the embodiment of FIGS. 1 to 2 are omitted. In the embodiment of FIG. 4, the first discharge passage 75 and the second discharge passage 76 are connected to the second pressure chamber 56, and only the second pressure chamber 56 forms a part of the refrigerant circuit.

In the embodiments of FIGS. 3 and 4, only one of the pressure chambers 55, 56 that does not form part of the refrigerant circuit is exposed to the pressure PdH or PdL at the corresponding pressure monitoring point P1 or P2 through the corresponding pressure introduction passage 91, 92. Therefore, compared to the example of FIG. 8, the number of pressure introduction passages is reduced.

In the embodiments of FIGS. 3 and 4, a throttle 93 may be located between the pressure chambers 55, 56 and the corresponding pressure monitoring points P1, P2. In this case, the pressure difference ΔPd is sufficient event if the pressure-monitoring point P1 of FIG. 4 and the pressure monitoring point P2 in FIG. 3 are relatively close to the passage 91, 92 can be shortened.

Figure 5A:
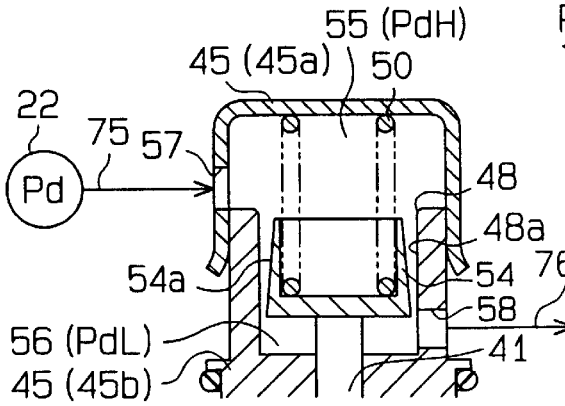
FIG. 5(*a*) is an enlarge cross-sectional view illustrating a control valve according to a fourth embodiment.
Figure 5B:
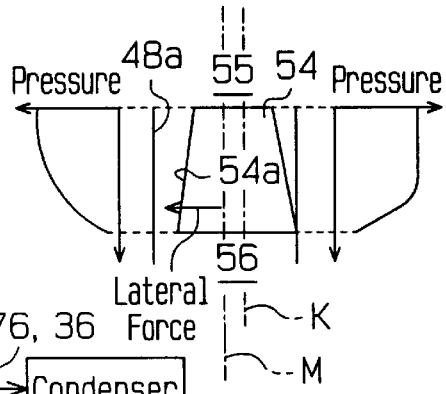

The throttle passage 68, the communication chamber 59 and the through holes 69 may be omitted from the embodiment of FIG. 1, and the pressure chamber 55, 56 may be connected with each other by a passage that is located outside the pressure-sensing member 54. For example, as in a fourth embodiment shown in FIGS. 5(*a*) and 5(*b*), a space may be created between the outer surface 54*a* of the pressure-sensing chamber 48. The space reduces the friction between the member 54 and the inner surface 48*a* of the pressure-sensing pressure-sensing member 54 and the pressure-sensing chamber 48. In FIG. 5(*a*), the space is exaggerated for purposes of illustration. The passage may be formed in the valve housing 45 or outside of the control valve CV and within the rear housing member 4.

In the embodiment of FIG. 5(*a*), a relatively great space can be created between the outer surface 54*a* of the pressure-sensing member 54 and the inner surface 48*a* of the pressure-sensing member 48. Thus, foreign matter is not likely to get caught between the pressure-sensing member 54 and the pressure sensing chamber 48. Further, the outer surface 54*a* is tapered toward the first pressure chamber 55, that is, the diameter of the pressure-sensing member 54 decreases toward the first pressure chamber 55. Therefore, the space between the surfaces 54*a* and 48*a* increases from the second pressure chamber 56 toward the first pressure chamber 55. Thus, when refrigerant flows from the first pressure chamber 55 to the second pressure chamber 56, the refrigerant flow moves the pressure-sensing member 54 to align adequately.

If the axis K of the pressure-sensing member 54 becomes misaligned with, or offset from, the axis M of the valve housing 45 as shown, for example, in the diagrammatic view of FIG. 5(*b*), the space between the pressure-sensing member 54 and the wall of the pressure-sensing chamber 48 is less at the right side than the left side as viewed in the drawing. In this case, the pressure at the right decreases from the small diameter portion toward the large diameter portion of the outer surface 54*a*. In particular, the pressure at the right side steeply drops in the vicinity of the large diameter portion. At the left side as viewed in the drawing, the pressure gradually decreases from the small diameter portion toward the large diameter portion of the outer surface 54*a*. Therefore, a force, the direction of which is opposite to the direction of the offset, acts on the pressure-sensing member 54 and the misalignment of the pressure sensing member 54 relative to the axis M of the valve housing 45 is automatically corrected.

Figure 6:
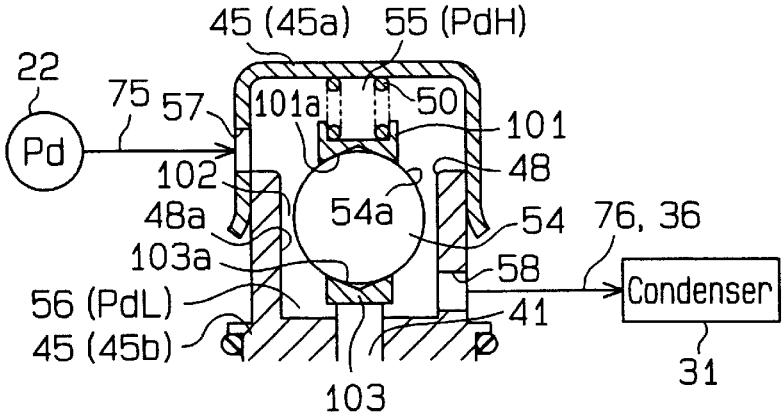
FIG. 6 is an enlarged cross-sectional view illustrating a control valve according to a fifth embodiment.

In a fifth embodiment shown in FIG. 6, a ball 54 is used as a pressure sensing member. Since the ball 54 need not be set in a specific orientation, the installation of the ball 54 during the assembly of the control valve CV is easy. A first seat 101 is located between the ball 54 an the first spring 50. A second seat 103 is located between the distal end portion 41 of the operation rod 40 and the ball 54. Conical recesses 101*a*, 103*a* are formed on surfaces of the fist and second seats 101, 103 that contact the ball 54, respectively.

Thus, the ball 54 is reliably held between the recesses 101*d*, 103*d*. Even if the ball 54 receives an unbalanced load, force that inclines the operation rod 40 is not generated. This prevents the control valve CV from being affected by hysteresis. In FIG. 6, a space 102, which connects the first pressure chamber 55 with the second pressure chamber 56, is exaggerated for purposes of illustration.

Figure 7:
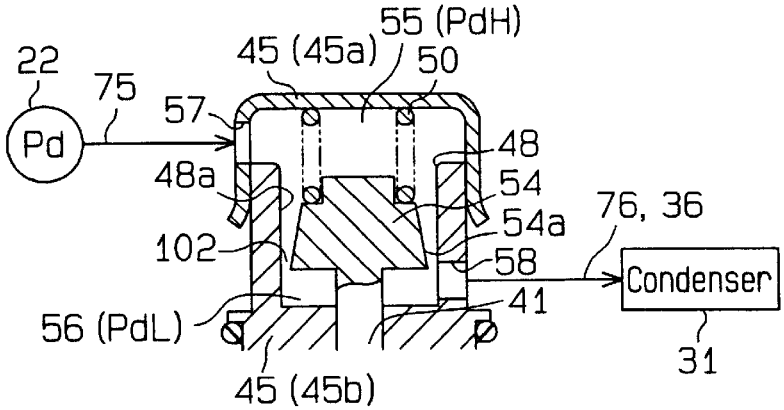
FIG. 7 is an enlarged cross-sectional view illustrating a control valve according to a sixth embodiment.

In a sixth embodiment shown in FIG. 7, the pressure-sensing member 54 is integrated with the operation rod 40. This reduces the number of parts of the control valve CV. Further, since the pressure-sensing member 54 is supported by the operation rod 40 in the pressure-sensing chamber 48, the pressure-sensing member 54 does not collide with the inner surface 48*a* of the pressure-sensing chamber 48, which prevents noise and vibration of the control valve CV. Also, since the friction between the pressure-sensing member 54 and the pressure-sensing chamber 48 is eliminated, the control valve CV is prevented from being affected by hysteresis.

A space 102 for connecting the first pressure chamber 55 with the second pressure chamber 56 is exaggerated for purpose of illustration. The outer surface 54*a* of the pressure-sensing member 54 is tapered from the second pressure chamber 56 toward the first pressure chamber 55 so that the diameter decreases toward the first pressure chamber 55. The embodiment of FIG. 7 has the same advantages as the embodiment of FIG. 5.

The communication passage 47 may be connected to the discharge chamber 22 through the port 52 and the upstream section of the supply passage 28, and the valve chamber 46 may be connected to the crank chamber 5 through the port 51 and the downstream portion of the supply passage 28. This structure reduces the difference between the pressure in the communication passage 47 and the pressure in the second pressure chamber 56, which is adjacent to the communication passage 47. This prevents refrigerant from leaking between the communication passage 47 and the second pressure chamber 56 and thus permits the compressor displacement to be accurately controlled.

The first pressure chamber 55 and the second pressure chamber 56 may be exposed to the pressure of the suction pressure zone of the refrigerant circuit, and at least one of the pressure chambers 55, 56 may form a part of the refrigerant circuit.

The first pressure chamber 55 may be exposed to the pressure of the discharge pressure zone of the refrigerant circuit, the second pressure chamber 56 may be exposed to the pressure of the suction pressure zone of the refrigerant circuit, and at least one of the pressure chambers 55, 56 may form a part of the refrigerant circuit.

The control valve CV1 is an bleed side control valve for controlling the degree of opening of the bleed passage 27.

The housing of the compressor may form the valve housing 45 of the control valve CV. That is, the operation rod 40 and the pressure-sensing member 54, which form the control valve CV, may be directly installed in the compressor housing.

The present invention may be embodied in a control valve of a wobble type variable displacement compressor.

A power transmission mechanism PT with a clutch mechanism such as an electromagnetic clutch may be used.

Therefore, the present example and embodiments are to be considered as illustrative and not restrictive and the invention is not to be limited to the details given herein, but may be modified within the scope and equivalence of the appended claims.

What is claimed is:

1. A control valve used for a variable displacement compressor installed in a refrigerant circuit of a vehicle air conditioner, wherein the refrigerant circuit communicates a condenser with a discharge chamber, wherein the compressor varies the displacement in accordance with the pressure in a crank chamber, wherein the compressor has a control passage, which connects the crank chamber to a pressure zone in which the pressure is different from the pressure of the crank chamber, the control valve comprising:

a valve housing;

a valve chamber defined in the valve housing;

a valve body, which is accommodated in the valve chamber for adjusting the opening size of the control passage;

a pressure sensing chamber defined in the valve housing; and a pressure sensing member, which separates the pressure sensing chamber into a first pressure chamber and a second pressure chamber, wherein the first or second pressure chamber forms a part of the refrigerant circuit, wherein the pressure at a first location in the refrigerant circuit is applied to the first pressure chamber, wherein the pressure at a second location in the refrigerant circuit, which is downstream of the first location, is applied to the second pressure chamber, wherein the pressure sensing member moves the valve body in accordance with the pressure difference between the first pressure chamber and the second pressure chamber such that the displacement of the compressor is varied to counter changes of the pressure difference, and wherein at least one of the first pressure chamber and the second pressure chamber forms a part of the refrigerant circuit.

2. The control valve according to claim 1, wherein the first pressure chamber and the second pressure chamber form a part of the refrigerant circuit.

3. The control valve according to claim 1, wherein the refrigerant circuit has a pressure passage that connects the first pressure chamber to the second pressure chamber.

4. The control valve according to claim 3, wherein the pressure passage includes a throttle, which restricts flow of refrigerant from the first pressure chamber to the second pressure chamber.

5. The control valve according to claim 3, wherein the pressure passage is formed in the pressure sensing member.

6. The control valve according to claim 3, wherein the pressure passage is formed by a clearance between an outer surface of the pressure sensing member and an inner surface of the pressure sensing chamber.

7. The control valve according to claim 6, wherein the outer surface of the pressure sensing member is tapered such that the diameter of the tapered surface decreases from the second pressure chamber toward the first pressure chamber.

8. The control valve according to claim 6, wherein one of the pressure chambers forms a part of the refrigerant circuit, wherein the refrigerant is introduced into the other pressure chamber through the clearance, and wherein the refrigerant of the other pressure chamber merges with the refrigerant circuit.

9. The control valve according to claim 6, wherein one of the pressure chambers forms a part of the refrigerant circuit, wherein the refrigerant is introduced in the other pressure chamber via a passage diverging from the refrigerant circuit, and wherein the refrigerant in the pressure chamber that forms the part of the refrigerant circuit merges with the other pressure chamber through the clearance.

10. The control valve according to claim 1 further comprising an actuator for applying force to the pressure sensing member in accordance with external commands, wherein the urging force applied by the actuator corresponds to a target value of the pressure difference, wherein the pressure sensing member moves the valve body such that the pressure difference seeks the target value.

11. The displacement control mechanism according to claim 10, wherein the actuator is a solenoid, which applies force in accordance with a supplied electrical current.

12. A control valve used for a variable displacement compressor installed in a refrigerant circuit of a vehicle air conditioner, wherein the refrigerant circuit communicates a condenser with a discharge chamber, wherein the compressor varies the displacement in accordance with the pressure in a crank chamber, wherein the compressor has a control passage, which connects the crank chamber to a pressure zone in which the pressure is different from the pressure of the crank chamber, the control valve comprising:

a valve housing;

a valve chamber defined in the valve housing;

a valve body, which is accommodated in the valve chamber for adjusting the opening size of the control passage;

a pressure sensing chamber defined in the valve housing; and a pressure sensing member, which separates the pressure sensing chamber into a first pressure chamber and a second pressure chamber, wherein the first or the second pressure chamber forms a part of the refrigerant circuit, wherein the second pressure chamber is located downstream of the location of the first pressure chamber in the refrigerant circuit, and wherein the pressure sensing member moves the valve body in accordance with the pressure difference between the first pressure chamber and the second pressure chamber such that the displacement of the compressor is varied to counter changes of the detected pressure difference.

13. The control valve according to claim 12, wherein a throttle is located in the refrigerant circuit between the first pressure chamber and the second pressure chamber.

14. The control valve according to claim 13, wherein the throttle is formed in the pressure sensing member.

15. The control valve according to claim 12, wherein a clearance exists between an outer surface of the pressure sensing member and an inner surface of the pressure sensing chamber, and wherein the clearance connects the first pressure chamber to the second pressure chamber and forms a part of the refrigerant circuit.

16. The control valve according to claim 15, wherein the outer surface of the pressure sensing member is tapered such that the diameter of the tapered surface decreases from the second pressure chamber toward the first pressure chamber.

17. The control valve according to claim 12 further comprising an actuator for applying force to the pressure sensing member in accordance with external commands, wherein the urging force applied by the actuator corresponds to a target value of the pressure difference, wherein the pressure sensing member moves the valve body such that the pressure difference seeks the target value.

18. The displacement control mechanism according to claim 17, wherein the actuator is a solenoid, which applies force in accordance with a supplied electrical current.

19. A control valve used for a variable displacement compressor installed in a refrigerant circuit of a vehicle air conditioner, wherein the compressor varies the displacement in accordance with the pressure in a crank chamber, wherein the compressor has a control passage, which connects the crank chamber to a pressure zone in which the pressure is different from the pressure of the crank chamber, the control valve comprising:

a valve housing;

a valve chamber defined in the valve housing;

a valve body, which is accommodated in the valve chamber for adjusting the opening size of the control passage;

a pressure sensing chamber defined in the valve housing; and a pressure sensing member, which separates the pressure sensing chamber into a first pressure chamber and a second pressure chamber, wherein all of the refrigerant which flow in the refrigerant circuit pass through the first or second pressure chamber, wherein the pressure at a first location in the refrigerant circuit is applied to the first pressure chamber, wherein the pressure at a second location in the refrigerant circuit, which is downstream of the first location, is applied to the second pressure chamber, wherein the pressure sensing member moves the valve body in accordance with the pressure difference between the first pressure chamber and the second pressure chamber such that the displacement of the compressor is varied to counter changes of the pressure difference, and wherein at least one of the first pressure chamber and the second pressure chamber forms a part of the refrigerant circuit.

* * * * *

UNITED STATES PATENT AND TRADEMARK OFFICE

CERTIFICATE OF CORRECTION

PATENT NO. : 6,604,912 B2
DATED : August 12, 2003
INVENTOR(S) : Ken Suitou et al.

It is certified that error appears in the above-identified patent and that said Letters Patent is hereby corrected as shown below:

Title page, Item [54] and Column 1, lines 1-7,
Title, should read -- A CONTROL VALVE USED FOR A VARIABLE DISPLACEMENT COMPRESSOR INSTALLED IN A REFRIGERANT CIRCUIT HAVING AT LEAST ONE OF A FIRST PRESSURE CHAMBER AND A SECOND PRESSURE CHAMBER FORMING PART OF THE REFRIGERANT CIRCUIT --

Column 6,
Line 62, please delete "can" and insert therefor -- (an --

Signed and Sealed this

Twenty-third Day of March, 2004

JON W. DUDAS
*Acting Director of the United States Patent and Trademark Office*